US009440102B2

(12) United States Patent
Fernstrum et al.

(10) Patent No.: US 9,440,102 B2
(45) Date of Patent: Sep. 13, 2016

(54) HIGH SPEED AUTOMATIC FIRE SUPPRESSION SYSTEM AND METHOD

(71) Applicant: TYCO FIRE PRODUCTS LP, Lansdale, PA (US)

(72) Inventors: Marvin B. Fernstrum, Menominee, MI (US); Joshua L. Ehlers, Marinette, WI (US); Brian L. Counts, Greenbay, WI (US); Richard J. Biehl, Marinette, WI (US); Richard J. Hackl, Greendale, WI (US); Anthony J. Kreft, Oak Creek, WI (US); Marvin D. Thorell, Racine, WI (US); Paul J. Beyerl, Waterford, WI (US)

(73) Assignee: Tyco Fire Products LP, Lansdale, PA (US)

( * ) Notice: Subject to any disclaimer, the term of this patent is extended or adjusted under 35 U.S.C. 154(b) by 193 days.

(21) Appl. No.: 14/028,044

(22) Filed: Sep. 16, 2013

(65) Prior Publication Data

US 2014/0069665 A1 Mar. 13, 2014

Related U.S. Application Data

(63) Continuation of application No. 13/814,482, filed as application No. PCT/US2011/047139 on Aug. 9, 2011, now abandoned.

(60) Provisional application No. 61/372,394, filed on Aug. 10, 2010.

(51) Int. Cl.

| | |
|---|---|
| ***A62C 3/07*** | (2006.01) |
| ***A62C 37/44*** | (2006.01) |
| ***A62C 37/36*** | (2006.01) |

(52) U.S. Cl.

CPC ..... *A62C 3/07* (2013.01); *A62C 37/04* (2013.01); *A62C 37/36* (2013.01); *A62C 37/44* (2013.01)

(58) Field of Classification Search

USPC ..... 169/16, 56, 60, 61, 62; 340/577, 584

See application file for complete search history.

(56) References Cited

U.S. PATENT DOCUMENTS

| | | | | |
|---|---|---|---|---|
| 4,255,789 | A * | 3/1981 | Hartford et al. | 701/108 |
| 4,281,717 | A | 8/1981 | Williams | |
| 5,091,847 | A * | 2/1992 | Herbermann | 714/3 |

(Continued)

FOREIGN PATENT DOCUMENTS

| | | |
|---|---|---|
| EP | 1393778 | 3/2004 |
| WO | WO2010/151386 | 12/2010 |
| WO | WO2012/021549 | 2/2012 |

OTHER PUBLICATIONS

Microsoft Computer Dictionary, Fifth Edition, Published May 1, 2002.*

(Continued)

*Primary Examiner* — Justin Jonaitis

(74) *Attorney, Agent, or Firm* — Perkins Coie LLP

(57) ABSTRACT

An automatic fire suppressing system is preferably provided onboard a vehicle and is supplied with one or more fire suppressing agents that are discharged in response to detecting a fire threat. Preferred embodiments include high-speed valves for discharging the fire suppressing agent(s), optical detectors for detecting and evaluating fire threat conditions, and modules for monitoring and controlling the automatic fire suppressing system.

20 Claims, 2 Drawing Sheets

(56) References Cited

U.S. PATENT DOCUMENTS

| | | | | |
|---|---|---|---|---|
| 5,117,219 | A * | 5/1992 | Tice et al. | 340/518 |
| 5,236,049 | A * | 8/1993 | Asselin et al. | 169/61 |
| 5,486,811 | A * | 1/1996 | Wehrle et al. | 340/522 |
| 2003/0150625 | A1* | 8/2003 | Smith et al. | 169/56 |
| 2011/0168416 | A1* | 7/2011 | Frasure et al. | 169/61 |

OTHER PUBLICATIONS

Andrew Tanenbaum, Structured Computer Organization, Fifth Edition, Published 2007.*

International Searching Authority, International Search Report and Written Opinion issued in International Application No. PCT/US2011/047139, Dec. 8, 2011, 10 pages.

U.S. Appl. No. 61/372,394, filed Aug. 10, 2010, 82 pages.

IFW of European Patent Application No. 11758594.3, filed Sep. 14, 2015, 172 pages (EP Phase App of PCT/US2011/047139).

Communication pursuant to Article 94(3) EPC, European Application No. 11 758 594.3, Jun. 17, 2016 (5 pages).

Excerpt from "NFPA® 2001 Standard on Clean Agent Fire Extinguishing Systems," 2008 Edition, sections 1.4 and 1.5, National Fire Protection Agency, Quincy, Massachusetts.

* cited by examiner

HIGH SPEED AUTOMATIC FIRE SUPPRESSION SYSTEM AND METHOD

CROSS-REFERENCE TO RELATED APPLICATION(S)

This application is a continuation application of U.S. patent application Ser. No. 13/814,482, filed Feb. 5, 2013, which is a 35 U.S.C. §371 application of International Application No. PCT/US2011/047139 filed Aug. 9, 2011, which claims the benefit of priority to U.S. Provisional Patent Application No. 61/372,394, filed Aug. 10, 2010, each of which is incorporated by reference in its entirety.

BACKGROUND OF THE INVENTION

Conventional systems for suppressing a fire onboard a vehicle may dispense suppressing agents, e.g., heptafluoropropane and/or sodium bicarbonate, in a similar manner. The primary differences among these conventional systems are in the number of components that each system includes and in the quantity of suppressing agent that each system contains. These conventional systems may also include reserve or secondary systems that are identical to the primary systems.

Conventional automatic systems may be used to protect an area, e.g., a passenger compartment of a vehicle, against slow growth and rapidly developing petroleum, oil, and lubricant (POL) type fires by utilizing a combination of heptafluoropropane and sodium bicarbonate.

SUMMARY OF THE INVENTION

Automatic fire suppression systems (also referred to as "AFES") according to a preferred embodiment sense a fire, and preferably extinguish the fire in less than approximately 300 milliseconds, and preferably less than approximately 200 milliseconds after inception of a fire. The time it takes for a fire suppression system to extinguish a fire is preferably evaluated by introducing "Jet Propellant 8" fuel ("JP-8"), which is preheated to approximately 180-190° Fahrenheit and pressurized to approximately 1200 pounds per square inch, into an approximately 260 cubic foot compartment. The preheated and pressurized fuel is ignited for approximately 250 milliseconds after being introduced into the compartment and is allowed to flow for approximately 1.25 seconds. Further, a suppressing agent used to extinguish the fire is dispersed in the compartment in a concentration that is less than a "Lowest Observed Adverse Effects Level" ("LOAEL;" described by the National Fire Protection Association in NFPA 2001: Standard on Clean Agent Fire Extinguishing Systems, Sections 1.4 and 1.5) and preferably less than a "No Observed Adverse Effects Level" ("NOAEL;" id.).

Preferably, AFES according to a preferred embodiment sense a fire in less than approximately 10 milliseconds and preferably less than approximately five milliseconds. The time it takes to sense a fire is preferably evaluated between inception of the fire and detecting the inception of the fire.

Preferably, AFES according to a preferred embodiment commence dispersing a fire suppressing agent in less than approximately 100 milliseconds and preferably less than approximately 50 milliseconds. The time it takes to commence dispersing a suppressing agent is preferably evaluated between inception of a fire and the suppressing agent being discharged, e.g., exiting a nozzle of a fire suppressing system.

Preferably, AFES according to a preferred embodiment develop less than approximately 1000 parts per million ("ppm") of Hydrogen Fluoride in the compartment, and preferably less than approximately 746 ppm. Hydrogen Fluoride develops, for example, when a Halon compound is used as an agent to suppress a fire.

AFES according to a preferred embodiment include a high-speed valve assembly that may be used with any of several different classes of fire suppressing agent cylinders. Individual high-speed valve assemblies preferably include a release module that preferably is connected to an electronic control module ("ECM"), a pressure sensor and a protracting actuation device ("PAD") as will be described in detail below. When the release module receives a signal from the ECM, the release module sends an electrical pulse to the PAD to actuate the high-speed valve assembly. The high-speed valve assembly preferably includes a burst disc for releasing the fire suppressing agent(s) in less than approximately 270 milliseconds after receiving the signal from the ECM. Preferably, the suppressing agent(s) in Class I and II cylinders are released in less than approximately 100-130 milliseconds and the suppressing agents in Class III cylinders are released in less than approximately 180 milliseconds. The release module preferably communicates with the pressure sensor and ECM to confirm activation and cylinder discharge.

Preferably, the ECM communicates via a first data bus with at least one sensor for detecting a fire and communicates via a second data bus with nodes that preferably include the release modules. According to certain preferred embodiments, the ECM preferably polls individual sensors on the first data bus at a first polling frequency and polls individual nodes on the second data bus at a second polling frequency that is slower than the first polling frequency. "Polling" preferably refers to a program actively sampling the status of an external device, and "polling frequency" accordingly preferably refers to a rate at which the external device is sampled. According to certain preferred embodiments, the ECM preferably polls individual sensors on the first data bus with first messages having a first size and polls individual nodes on the second data bus with second messages having a second size that is greater than the first size of the first messages. A "message" preferably refers to a signal sent by the program to the external device. Messages can include, for example, an identifier for an individual external device and a prompt for the individual external device to provide a response. According to certain preferred embodiments, the ECM is preferably configured to communicate first polling messages to the at least one sensor and to communicate second polling messages to the at least one node, and neither the first data bus nor the second data bus communicate both the first and second polling messages.

AFES according to a preferred embodiment are preferably flexibly configured because of modularity. Modularity permits AFES to be configured for releasing a fire suppressing agent in one or a plurality of zones of a vehicle. Modularity also permits adding or deleting modules for reconfiguring AFES for a vehicle. Modularity further permits AFES to be repaired by replacing individual modules and/or components. Preferably, modularity permits an electronic control module, one or more sensors, one or more detection modules, one or more remote discharge devices, one or more notification modules, one or more relay modules, and/or one or more suppressor assemblies to be operably coupled via a wiring harness assembly.

AFES according to a preferred embodiment are highly controllable. For example, more than one location on a vehicle preferably controls releasing the fire suppressing agent(s). Controls also preferably permit dispensing a fire suppressing agent in one or a plurality of zones of a vehicle and concurrently and/or sequentially dispensing a "shot" or portion of a fire suppressing agent contained in one or more cylinders. Preferably, controls further permit AFES modules to communicate via one or more networks, including a vehicle communication network, and permit conversion of a control level signal to an actuation level signal for dispensing a fire suppressing agent. Preferably, controls still further permit a battery backup module to be disconnected to perform AFES maintenance. Preferably, controls also further permit running an AFES fault diagnosis routine.

BRIEF DESCRIPTION OF THE DRAWINGS

The accompanying drawings, which are incorporated herein and constitute part of this specification, illustrate exemplary embodiments of the invention, and, together with the general description given above and the detailed description given below, serve to explain the features of the invention.

DETAILED DESCRIPTION OF THE PREFERRED EMBODIMENTS

As installed, individual AFES are preferably provided onboard a vehicle (not shown) and are supplied with one or more fire suppressing agents that are discharged in response to detecting a fire threat. Preferred embodiments include high-speed valves for discharging the fire suppressing agent (s) in crew cabs, optical detectors for detecting and evaluating fire threat conditions, and modules for monitoring and controlling AFES. Relatively lower-speed valves are preferably for discharging fire suppressing agent(s) in non-crew areas of the vehicle, e.g., engine bays, wheel wells, fuel tanks, or cargo holds, etc. AFES may be installed in accordance with the 30 Sep. 1998 Edition of the Detail Specification for Valve and Cylinder Assemblies, Halon 1301, MIL-DTL-62547C(AT) (1998 edition), which is incorporated by reference herein in its entirety.

Figure 1:
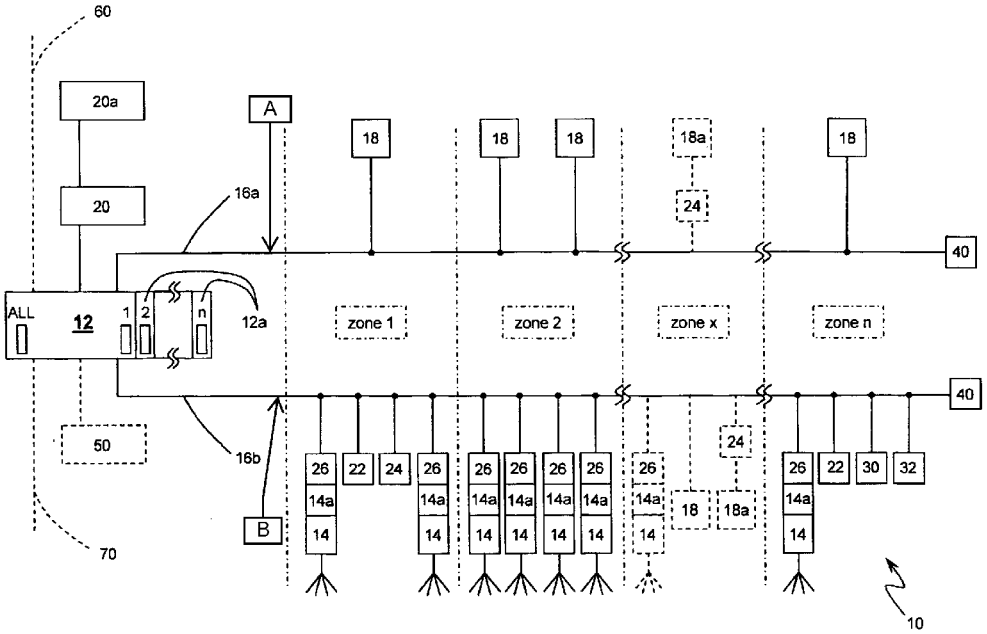
FIG. 1 is a schematic drawing illustrating a preferred embodiment of an automatic fire suppressing system. The automatic fire suppressing system preferably includes one to n zones, which are demarcated by dash-dot lines. Dash lines illustrate optional arrangements in a zone x, which may be any one of the zones.

FIG. 1 schematically shows an individual AFES 10 according to a preferred embodiment. AFES 10 includes an ECM 12, at least one suppressor assembly 14 (seven are shown with solid lines and one is shown with dash line in FIG. 1), and a wire harness assembly preferably including a first communications wiring harness 16*a* and a second communications wiring harness 16*b*. Each suppressor assembly 14 is associated with a release module 26 that communicates with ECM 12 via second wire communications wiring harness 16*b*. Each release module 26 may control a single suppressor assembly 14 or plural suppressor assemblies 14 (not shown). AFES 10 preferably also includes at least one detection device such as an optical sensor 18 (four are shown with solid lines and one is shown with dash line in FIG. 1), a linear detection wire, and/or a spot thermal detector. Reference number 18*a* in zone x preferably denotes one or the other of another optical sensor, the linear detection wire and the spot thermal detector, any of which may be coupled to either the first communications wiring harness 16*a* or the second communications wiring harness 16*b*. Options for AFES 10 preferably include mounting hardware, a battery backup module 20, remote discharge switch(s) 22 (two are shown in FIG. 1), one or more additional detection modules 24 (one is shown with solid lines and two are shown with dash line in FIG. 1), one or more relay modules 30, and one or more notification modules 32. Preferably, detection module 24 may provide a coupling for a linear detection wire, a spot thermal detector, or another sensor that would otherwise not be able to communicate with ECM 12.

Preferably, AFES 10 may protect additional areas or different zones within an area by using one or more optional zone modules 12*a* (two are shown in FIG. 1) coupled to ECM 12 as will be discussed in detail below. A "zone" is preferably a specific compartment, group of compartments, or hazard area that is to be protected. Examples of zones include a crew cab, an engine compartment, a cargo bay, an egress portal, a wheel well, etc. In some vehicles, multiple compartments can be protected as one zone if, for example, a comparable hazard exists in each compartment.

ECM 12 includes monitoring and controlling for one protection zone having at least one suppressor assembly 14. Preferably, each zone has a maximum of four suppressor assemblies 14 that ECM 12 controls, e.g., see zone 2 in FIG. 1. Certain other embodiments according to a preferred embodiment may include more than four suppressor assemblies in a zone. ECM 12 is preferably expanded with one or more zone modules 12*a* for monitoring and controlling additional protection zones. Preferably, a maximum of seven zone modules 12*a* may be added side-by-side to ECM 12 for monitoring and controlling a total of eight protection zones. Certain other embodiments preferably may include more than eight protection zones.

ECM 12 includes an enclosure that is preferably made of a light weight alloy with integral mounting feet to provide structural integrity and the smallest foot print possible. The electrical components disposed in the enclosure are preferably encapsulated to ensure protection in the harshest of environments. A side cap of ECM 12 is removable to attach the zone module 12*a* for zones 2-*n* and may then be reinstalled at the side of the zone module 12*a* for zone n to keep contaminants out of the expanded ECM enclosure. Preferably, gaskets are used between ECM 12 and zone module 12*a* for zone 2, between each additional zone module 12*a* for up to n zones, and between zone n module 12*a* and the side cap to ensure proper sealing.

A "DISCHARGE ALL" switch, preferably labeled "ALL" on the left side of ECM 12, preferably initiates the discharge of all available suppressor assemblies 14 in all n zones. A preferred embodiment discharges all of the available suppressor assemblies 14 concurrently in a single shot when the "DISCHARGE ALL" switch is actuated. Preferably, a "shot" consists of one to four suppressor assemblies 14 in each zone and programmed to discharge together for discharging all available suppression agent(s) to a protection area. Alternatively, individual suppressor assemblies 14 preferably can make available multiple shots to provide only a portion of the available suppression agent(s) in a measured response to a fire threat, a backup system for responding to a fire threat, and/or secondary system for responding to subsequent fire threats. ECM 12 and every zone module 12*a* include a "DISCHARGE" switch, e.g., labeled "1," "2" and "n" on ECM 12 in FIG. 1, to initiate the discharge of all available suppressor assemblies in a specific zone that is associated with a particular "DISCHARGE" switch.

A "SYSTEM STATUS" indicator on ECM 12, e.g., a first LED, preferably provides a visual indication of the status of AFES 10. An "ALARM" indicator on ECM 12 and each zone module 12*a*, e.g., a second LED, monitors the status of the particular zone with which it is associated. A set(s) of "SUPPRESSOR STATUS" indicators also on ECM 12 and each zone module 12*a*, e.g., a plurality of LEDs, monitor the status of the suppressor assembly(s) 14 and how many suppressor assemblies 14 are available in the corresponding zone.

Preferably, ECM 12 includes a "SDR/RESET" button to initiate a system diagnostic routine (SDR) and/or resets any faults or alarms in AFES 10. A "SILENCE" button on ECM 12 preferably silences any audible alarms connected to AFES 10.

During automatic operation for crew cabs, e.g., areas occupied by humans, canines, or other breathing animals, or other areas that include optical sensor(s) 18, the optical sensor(s) 18 sends a signal to ECM 12 when a fire is detected. Preferably, optical sensor 18 can distinguish between small and large fires. For example, the optical sensor 18 may send a small fire signal to ECM 12, and the "ALARM" indicator on ECM 12 may preferably pulse red twice per second and/or sound an audible alarm before latching five seconds after a fire condition is detected. If optical sensor 18 sends a large fire signal to ECM 12, the "ALARM" indicator on ECM 12 may preferably pulse red four times per second and/or sound an audible alarm before latching for five seconds after fire is detected. With a large fire signal, ECM 12 preferably sends a signal to release module(s) 26 to initiate releasing the fire suppressing agent (s) from one or more suppressor assemblies 14 in the protected area. With a small fire signal, ECM 12 preferably displays the "ALARM" indicator and does not discharge any suppressor assemblies 14 to allow crew members to suppress the fire with a hand portable suppressor. This keeps AFES 10 available for subsequent fire threats. Audio and/or visual notifications and sequences other than those described above are also envisioned.

Automatic operation to protect an area that is not occupied by a crew member preferably includes a linear detection module/thermal spot detector 18*a* sending a signal via a detection module 24 to ECM 12 when a fire is detected. Alternatively, optical sensor 18 may send a signal to ECM 12 when a fire condition is detected in an area that is not occupied by a crew member. ECM 12 preferably then sends a signal to release module(s) 26 to initiate releasing the fire suppressing agent(s) from one or more suppressor assemblies 14 in the protected area where the fire was detected.

In manual mode, the suppressor assemblies 14 in all protected areas can be discharged by the "DISCHARGE ALL" switch on ECM 12. Suppressor assemblies 14 in specific protected areas can be discharged by operating the "DISCHARGE" switch on the front panel of ECM 12 that is associated with the specific protected area or by operating remotely mounted a remote discharge switch 22 that is programmed for the specific protected area. Alternatively, remotely mounted switch(es) 22 can be programmed for discharging the suppressor assemblies in all or multiple protected areas.

Preferably, the discharged status of the suppressor assemblies 14 for the protected area(s) will be indicated by ECM 12, and optionally on notification module 32 associated with an individual zone. The release module(s) 26 preferably will go into a fault condition until the corresponding suppressor assembly 14 is recharged and the "SDR/RESET" button on ECM 12 is depressed (or AFES 10 is shutdown and restarted during a recharge procedure).

ECM 12 preferably includes electrical connections for monitoring and controlling AFES 10. Preferably, ECM 12 is electrically coupled to AFES 10 by six connectors including a "POWER" connector for receiving incoming power, e.g., from the vehicle battery 20*a* or the battery backup module 20; a "SETUP" connector to interface with a computer 50 for, e.g., programming ECM 12 or downloading historical data that is acquired; a "CAN" connector 60 to interface with a vehicle computer (not shown) using any suitable protocol; an "AUX" connector 70 providing an output signal, e.g., 24 Vdc, that can optionally be used by an auxiliary device such as a ventilator (not shown) for ventilating the zone after a discharge occurs; and an "'A' BUS" connector coupled to first communications wiring harness 16*a* and a "'B' BUS" connector coupled to second communications wiring harness 16*b*.

Features of ECM 12 preferably include a modular design for ease of coupling zone modules 12*a* to include additional zones, power fault monitoring, a self diagnostic routine, IP67 or greater sealed enclosures and connectors, light weight alloy enclosures with integral mounting feet for installation on any flat surface, sealed membrane push buttons, suppressor tank pressure-monitoring, selectable protection area configuration, CAN-bus capability using an suitable protocol, a programmable power down delay, computer interface for programming, 24 VDC auxiliary output, notification/alarm circuit monitoring, and an audible alarm silence button.

ECM 12 preferably conducts a System Diagnostic Routine (SDR) upon start up or anytime the "SDR/RESET" button on ECM 12 is depressed. The SDR preferably validates at least one of (1) system component communication; (2) presence of all components per system configuration; and (3) capability of the optical sensor(s) 19 to communicate a small or large fire signal. Preferably, the "SYSTEM STATUS" indicator on ECM 12 will indicate if AFES 10 does not pass the SDR, e.g., pulse amber once per second along with an optional audible alarm, and the defective or non-responsive AFES component(s) will either not function, e.g., no indication of power will appear, or include an alert indicator, e.g., an LED may pulse amber once per second indicating power is available but there are communication problems. When AFES 10 successfully passes the SDR, preferably a green "SYSTEM STATUS" indicator on ECM 12, a green "BATTERY BACKUP" indicator on ECM 12, and a red "ALARM" indicator on ECM 12, as well as available "SUPPRESSOR STATUS" indicators on ECM 12, will activate for a predetermined period, e.g., five seconds, and/or sound an audible alarm. Audio and/or visual notifications and sequences other than those described above are also envisioned and may be provided on notification module (s) 32.

ECM 12 preferably manages one to four suppressor assemblies 14 per protection zone and displays their status using the set of "SUPPRESSOR STATUS" indicators on ECM 12. In the event of a discharge condition, preferably the "SUPPRESSOR STATUS" indicators on ECM 12 will pulse red for a predetermined period, e.g., five seconds, for each suppressor assembly that is discharged. If a suppressor assembly 14 fails to discharge or there is no discharge flow indication, preferably this will be indicated by 1) the "SYSTEM STATUS" indicator on ECM 12, 2) the "ALARM" indicator on ECM 12, and 3) and the "SUPPRESSOR STATUS" indicators on ECM 12. For example, these indicators preferably may rapidly pulse amber twice, e.g., once every three seconds, along with an optional audible alarm. The next suppressor assembly 14 that is installed, if available, will discharge if a discharge flow is not confirmed by ECM 12 for the preceding suppressor assembly(s) 14. Preferably, a "FAULT" condition in the suppressor monitoring circuit will be indicated with amber "SYSTEM STATUS" indicator on ECM 12 and "SUPPRESSOR STATUS" indicators on ECM 12 and, optionally, sound an audible alarm. The indicators/audible alarm preferably will pulse in a predetermined pattern, e.g., once every three seconds, until the "FAULT" condition is cleared. Audio and/or visual notifications and sequences other than those described above are also envisioned and may be provided on notification module(s) 32.

ECM 12 is preferably powered from the vehicle's battery 22*a* with the optional battery backup module 20. AFES 10 may optionally include a programmable AFES shut-down delay after the vehicle is shut down. Such an AFES shut-down delay is preferably programmable in half hour increments to ensure vehicle protection. Preferably, the AFES shut-down delay does not require optional battery backup module 20 and obtains power from vehicle batteries.

Preferably, backup module 20 can operate AFES 10 for a limited amount of time after a vehicle power failure. Battery backup module 20 can be connected in-line with the incoming power from vehicle battery 20*a* to ECM 12. With vehicle power connected, battery backup module 20 provides a secondary level of protection, e.g., preferably for a minimum of 10 minutes. In the event that vehicle power is lost or shut down, ECM 12 preferably immediately switches to battery backup module 20. ECM 12 preferably includes an internal timer to determine the amount of time battery backup is available. The maximum amount of time that the battery backup module 20 can operate AFES 10 is based on the individual configuration of AFES 10. Battery backup module 20 preferably includes a maintenance switch to deactivate the backup system for routine maintenance. A "STATUS" indicator on battery backup module 20, e.g., an LED, preferably gives a visual indication of the status of battery backup module 20. ECM 12 preferably provides power fault monitoring for both the vehicle battery 20*a* and battery backup module 20.

Preferably, optical sensor 18 provides early fire detection and signals ECM 12 in response to detecting a fire condition. Preferably, optical sensor 18 includes a light-weight, alloy enclosure with integral mounting feet to provide structural integrity and the smallest foot print possible. Optical sensor 18 is preferably encapsulated to ensure protection in the harshest of environments. A preferred embodiment of an optical sensor 18 may be made in accordance with Published Patent Cooperation Treaty Application No. WO2010/151386 or is commercially available from Spectrex Inc. of Cedar Grove, N.J., USA (e.g., SharpEye™ 20/20MI Mini Triple IR (IR3) Flame Detector).

The output from each optical sensor's infrared (IR) detector is analyzed by an algorithm that distinguishes between the signature of a hydrocarbon fire and a false alarm. For example, an open flame from a fuel-rich fire (using available oxygen) has a unique IR signature. Optical sensor 18 preferably determines if that IR signature is an actual hydrocarbon fire threat rather than an IR signature of a radiant heater, a fan with a heater, a cigar or cigarette, etc.

Optical sensor 18 preferably analyzes three IR bands to determine if a hydrocarbon fire threat is present. When the energies within these bands match predetermined detection thresholds, an alarm condition is preferably set. The difference between a large fire alarm and a small fire alarm is determined by the strength or amplitude of the IR signals, and the large or small fire detection thresholds. In all, preferably there are three distinct detection thresholds that must be set in order for the source to be classified as a hydrocarbon fire threat. This robust detection method eliminates false alarms.

Optical sensors 18 preferably include a test mode that allows a field technician to troubleshoot the sensors without risk of discharging a suppressor assembly 14. Preferably, the technician puts ECM 12 and optical sensor(s) 18 into a test mode by simultaneously depressing and holding "SDR/RESET" button on ECM 12 and "SILENCE" button on ECM 12 for a predetermined period, e.g., five seconds. An infrared source may be used for stimulating the IR detectors. An indicator, e.g., an LED, will indicate, e.g., flash red for five seconds, that the sensor electronics, software, and optics are operating properly. Optical sensor 18 preferably will remain in test mode until the test mode is reset by depressing the "SDR/RESET" button on ECM 12. Preferably, the test mode provides an added degree of safety and prevents or at least avoids accidental suppressor assembly discharges.

Wire harness 16 is preferably also modular in design, allowing for multiple drops and the addition of various lengths to ease AFES installation. Additional modules can simply be added anywhere along one of the bus line using a cable drop and changing the single cable of the bus line to two cables allowing re-routing to be very simple. Preferably, cable drops come in straight and 90° connectors on the lead end and all cable drops are preferably the same length to limit communication issues and reduce inventory. There is no field wiring required on the main lines—simply threading the connections together is all that is required. There are two connection points for the bus line on ECM 12. "'A' BUS" connector on ECM 12 is preferably used for optical sensors 18 in crew cabs. Preferably, a maximum of eight optical sensors 18 are connected to the "'A' BUS" along first communications wiring harness 16*a*. "'B' BUS" connector on ECM 12 preferably uses second communications wiring harness 16*b* for all other connections including, e.g., release module(s) 26 and remote discharge switch(es) 22. The two different bus lines preferably ensure proper priority for crew cabs as will be discussed in greater detail below. A terminator module 40 is preferably installed at the end of each bus to complete the electrical loop that allows ECM 12 to communicate with the components on the line. If a section of first or second communications wiring wire harnesses 16*a* and 16*b* gets damaged, preferably only that section needs to be replaced and not the entirety of first or second communications wiring wire harnesses 16*a* and 16*b*.

Preferably, remote discharge switch(es) 22 allow AFES 10 activation at locations remote from ECM 12. Preferably, remote discharge switch(es) 22 can be programmed to discharge all zones, specific zones, or one zone.

Preferably, detection module(s) 24 preferably monitor analog fire detection equipment such as spot thermal detectors, linear wire, etc. Detection module(s) 24 preferably link an analog device with the communication protocol used by AFES 10.

Preferably, release module(s) 26 monitor suppressor assembly discharge and pressure and relays this information to ECM 12. The release module(s) 26 preferably also supply the power to actuate a high-speed valve assembly 14*a* for discharging the suppressing agent(s) from individual suppressor assemblies 14.

A pressure sensor (not shown) associated with high-speed valve assembly 14*a* preferably monitors pressure in suppressor assembly 14 and determines if suppressor assembly 14 has discharged. Preferably, a pressure gauge (not shown) on high-speed valve assembly 14*a* provides a visual means for checking pressure in suppressor assembly 14. Preferably, high-speed valve assembly 14*a* also includes a fill valve (not shown) that is compatible with recharge equipment NSN 421-0-01 474-6206 for recharging suppressor assembly 14. Preferably, high-speed valve assembly 14*a* further includes a pressure relief valve (not shown) that provides a safety device to relieve over-pressurization of suppressor assembly 14.

Preferably, an individual suppressor assembly 14 discharges one or more suppressing agents in response to a signal from ECM 12. Suppressor assemblies 14 preferably are available in three different cylinder sizes and are identified as Class I, Class II, or Class III. The cylinders are preferably non-shatterable per MIL-DTL-7905H. The different suppressor assemblies 14 preferably are coupled via release module(s) 26 to ECM 12 and/or a pressure sensor (not shown) on suppressor assembly 14. Individual release module(s) 26 are preferably also connected to a protracting actuation device (PAD) as will be described in detail below. When release module 26 receives a signal from ECM 12, release module 26 sends an electrical pulse to the PAD to actuate high-speed valve assembly 14*a*, which preferably includes a burst disc, for releasing the suppressing agent(s) in less than about 270 milliseconds. Preferably, the suppressing agent(s) are discharged from Class I and II cylinders in less than about 100-130 milliseconds and from Class III cylinders in less than about 180 milliseconds. The discharge/feedback module 26 preferably communicates with the pressure sensor and ECM 12 to confirm activation and cylinder discharge.

A common high-speed valve assembly 14*a* is preferably used for each class of suppressor assembly cylinder. High speed valve assembly 14*a* preferably includes the pressure gauge (not shown) for visually identifying the cylinder pressure, the fill valve (not shown) that preferably also serves to relieve cylinder pressure, the cylinder pressure sensor (not shown), and the over-pressure relief device (not shown). Preferably, high-speed valve assembly 14*a* includes a manual override apparatus (not shown), e.g., a release lever. High-speed valve assembly 14*a* is preferably made of a light weight alloy providing exceptional performance within a light weight package.

Figure 2:
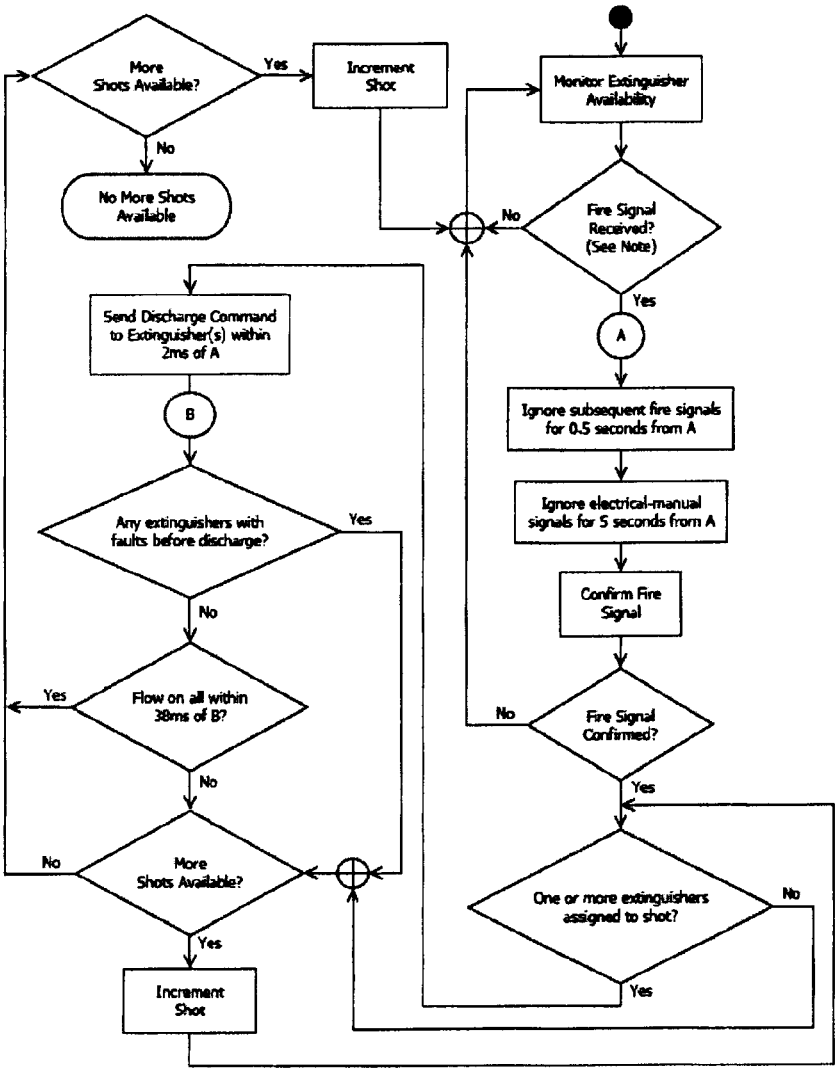
FIG. 2 is a logic diagram illustrating a preferred embodiment for activating in a single-zone the automatic fire suppressing system shown in FIG. 1.

FIG. 2 shows a logic diagram of a preferred embodiment for activating a single-zone AFES 10 as shown in FIG. 1. A fire signal is preferably generated either by ECM 12 responding to optical sensor 18 detecting a small or a large fire, actuating remote discharge switch 22, or actuating the manual override apparatus on high-speed valve assembly 14*a*. Preferably, AFES 10 senses a fire in less than approximately 10 milliseconds and preferably less than approximately five milliseconds. The time it takes to sense a fire is preferably evaluated between inception of the fire and detecting the inception of the fire. Preferably, a delay period following an initial fire signal is provided to allow ECM 12 to confirm the initial fire signal. ECM 12 also monitors the availability and desirability of firing one or more shots within a particular single zone.

Preferably, ECM 12 sends a signal via release module 26 to actuate high-speed valve assembly 14*a* so as to commence dispensing the suppressing agent(s) from suppressor assemblies 14 in less than approximately 100 milliseconds and preferably within approximately 50 milliseconds following inception of a fire. Preferably, the suppressor agent (s) flow to the zone commences within approximately 270 microseconds following ECM 12 sending a discharge signal.

Preferably, AFES 10 extinguishes a fire in less than 300 milliseconds, and preferably less than approximately 200 milliseconds after inception of the fire. The time it takes for AFES 10 to extinguish a fire is preferably evaluated by introducing "Jet Propellant 8" fuel ("JP-8"), which is preheated to approximately 180-190° Fahrenheit and pressurized to approximately 1200 pounds per square inch, into an approximately 260 cubic foot compartment. The preheated and pressurized fuel is ignited for approximately 250 milliseconds after being introduced into the compartment and is allowed to flow for approximately 1.25 seconds. Further, a suppressing agent used to extinguish the fire is dispersed in the compartment in a concentration that is less than a "Lowest Observed Adverse Effects Level" ("LOAEL;" described by the National Fire Protection Association in NFPA 2001: Standard on Clean Agent Fire Extinguishing Systems, Sections 1.4 and 1.5) and preferably less than a "No Observed Adverse Effects Level" ("NOAEL;" id.).

Features according to a preferred embodiment that contribute to the rapid response of AFES 10 include: (1) the separate 'A' and 'B' buses; (2) different polling frequencies by ECM 12 on the 'A' bus as compared to the 'B' bus; and/or (3) different polling message sizes sent by ECM 10 on the 'A' bus as compared to the 'B' bus.

Preferably, the 'A' bus is a specialty communication bus that allows for high-speed polling of optical sensors 18. Up to eight optical sensors 18 are preferably allowed on the 'A' bus; however, optical sensors 18 can be connected to either the 'A' or 'B' bus. For example, an optical sensor 18 is shown coupled to 'B' bus (second communication wiring harness 16*b*) in zone x. The 'B' bus is preferably the main communication bus that supports up to 60 nodes including, for example, remote discharge switches 22, detection modules 24, release modules 26, relay modules 30, and/or notification modules 32, all of which are only connected to the 'B' bus. The CAN connector 60 preferably can be used to communicate to external devices such as a vehicle engine or controls.

Preferably, ECM 10 communicates on the 'A' and 'B' buses using five message types: (1) high-speed check; (2) check; (3) set; (4) expansion; and (5) configuration. All messages except for the high-speed check message preferably have a two-byte cyclic redundancy check ("CRC") to help detect accidental changes in the message data. The high-speed check message preferably uses a one-byte CRC.

High-speed check messages are preferably used on the 'A' bus to poll optical sensors 18. To reach faster polling frequencies, these messages are preferably half the size of standard check messages and only contain three status flags: large fire, small fire, and fault. The fault flag is preferably a global fault flag indicates that one or more faults have occurred. Preferably, a follow-up standard check message determines the specific fault occurrence.

Check messages are preferably used for polling module status. Preferably, a request is sent to a module and the module replies with its status. Four status flags preferably make up a group called a "page" and one page is returned per request. Some modules have more than one page of status flags so preferably two or more check messages collect a module's complete status.

Set messages are preferably used for some module types to set outputs or properties. Preferably, when a set command is received, the module simply responds with the same command to acknowledge that the message has been received.

Expansion messages are preferably used for special case messages such as a module sync message that synchronizes the module indicators. Preferably, expansion messages are not sent to optical sensors 18, and are preferably used on the 'B' bus.

Configuration messages are preferably used for: (1) setting module addresses; (2) reading module addresses; (3) setting module serial numbers; and (4) reading module serial numbers. Preferably, module address messages are used during SDR to set up the communication network. Setting the module serial number is used preferably during initial module programming in a production facility. Reading a module serial number is preferably used to verify a serial number of a module if, for example, the serial number label on a node has been removed or damaged. Preferably, one module on the bus is allowed to respond to configuration messages. Serial numbers are preferably set and checked for modules on the 'B' bus.

Preferably, a maximum of eight optical sensors 18 are allowed on the 'A' bus. Polling on the 'A' bus preferably occurs every approximately 325 microseconds and a modified protocol and response handler are utilized to allow for increased polling frequency. Preferably, ECM 12 includes at least one cache that ECM 10 uses to compare a subsequent poll of each individual sensor with a preceding poll stored in the cache for that individual sensor. ECM 12 preferably analyzes the subsequent poll only if it differs from the preceding poll that is stored in the cache for the individual sensor. A small or large fire flag preferably queues an immediate fire verification poll. A fault flag preferably queues a more detailed fault check using a standard check message to gather fault details. Preferably, detailed fault checks are not immediately dispatched and one detailed fault check is performed between each high-speed polling sequence on the 'A' bus.

Module polling on the 'B' bus preferably occurs at a lower frequency than the 'A' bus. For example, modules on the 'B' bus are preferably polled every approximately five milliseconds as compared to polling on the 'A' bus every approximately 325 microseconds. Some modules are preferably polled twice to gather details in response to ECM 12 receiving a fault flag. For example, when gathering fault flags, an initial poll preferably occurs approximately five milliseconds after the previous poll with the follow-on poll occurring approximately one millisecond after the initial poll. The next module is then polled five milliseconds after the last poll.

Preferably, ECM 10 performs a system diagnostics routine ("SDR") to determine initial system status after, for example, a system reset. Preferably, a sequence of SDR events includes: cycling module power, performing an indicator lamp test, assigning module addresses, performing optical sensor large fire test, performing optical sensor small fire test, checking for discharge switch faults, retrieving initial status of modules, and reporting zone status and suppressor assembly availability.

ECM 10 preferably includes a discharge manager to control extinguisher discharge activities such as: fire detection confirmation, zone prioritization, detection lockout periods, suppressor assembly sequencing, and suppressor assembly flow confirmation. If a fire is detected by optical sensors 18, remote switch module 22, or detection module 26, then ECM 10 preferably requests a fire detection confirmation. The confirmation request is preferably sent out promptly after a fire signal is received and therefore interrupts all standard module polling on the 'B' bus. A confirmed fire detection preferably queues a discharge message and an unconfirmed fire is preferably recorded in a log.

After the discharge manager starts activating suppressor assemblies 14 in a zone, ECM 12 preferably ignores signals from optical sensors 18 in that zone for approximately 0.5 second and ignores fire detection signals from detection modules 26 for approximately five seconds. Remote switch modules 22 and "DISCHARGE" switch(es) on ECM 12 are locked out for approximately five seconds if the current suppressor activation was initiated by a remote switch module 22 or a "DISCHARGE" switch on ECM 12.

The discharge manager preferably prioritizes the zones such that, for example, zone 1 is highest priority and zone n is the lowest priority. If fire detection occurs in a zone, the zone is queued for a discharge message. The discharge manager scans the zones, starting with zone 1, until a zone has an action to perform such as activating a suppressor assembly 14 or confirming suppression agent flow. All discharge actions are preferably performed on higher priority zones before moving on to lower priority zones.

Suppressor assemblies 14 are preferably assigned up to four shots per zone. Upon resetting ECM 12, the discharge manager preferably resets all zones to "shot 1." When a discharge is queued, all suppressor assemblies 14 in the current shot preferably discharge a single shot. A shot count for each suppressor assembly 14 is accordingly incremented to be ready for the next discharge. The discharge manager preferably increments the shot count for individual suppressor assemblies 14 to "shot 4" and then reports no more shots in the history log. Preferably, the shot count is not reset until ECM 12 is reset.

Preferably, suppression agent flow confirmation starts approximately 25 milliseconds after the last suppressor assemblies 14 of the current zone shot has been commanded to discharge. All suppressor assemblies 14 in the current zone shot are polled for status. Approximately 10 milliseconds after the last extinguisher module of the current zone shot is polled, the suppressor assemblies 14 status replies are verified for flow. If any of the suppressor assemblies 14 in the current zone shot did not flow, the next zone shot is promptly queued for discharge.

A history log with timestamps is preferably stored in a non-volatile memory in ECM 12. The history can be downloaded and erased by computer 50 via the "SETUP" connector on ECM 12.

Preferably, an action queue provides a message handler for 'B' bus messages. The action queue preferably performs message dispatch scheduling and/or message prioritization based on the type of message. Message dispatch scheduling preferably controls periodic polling of modules. When a poll reply is received, the next poll is promptly scheduled. Preferably, a timer decrements to zero to time the dispatch of the next poll. Preferably, messages in the action queue have a message type that permits prioritization to allow more critical messages to be dispatched before less critical messages. Message types from highest to lowest priority preferably are as follows: (1) discharge; (2) flow verification; (3) fire verification; (4) set module; (5) check module; and (6) sync modules.

A discharge message preferably commands a suppressor assembly 14 to energize the PAD of a high-speed valve assembly 14*a*. Flow verification preferably sends a status check message to verify suppression assembly flow agent flow from suppressor assemblies 14. The responses for suppressor assemblies 14 are collected and verified. A fire verification message is preferably sent after a fire is detected during routine polling. Preferably, verification is sent promptly following the initial fire detection. A set message preferably sets module outputs or functionality. A check message is a standard polling message that is preferably used to check module status. A sync message preferably synchronizes module indicator light blink patterns.

Preferably, ECM 12 is configured via commands sent from computer 50 via "SETUP" connector on ECM 12. Configuring ECM 12 preferably includes identifying the number of modules on the 'A' and 'B' buses and identifying the number of zones in AFES 10. Configuring ECM 12 preferably further includes programming a period of time for AFES 10 to continue operating on vehicle battery power after the vehicle's alternator turns off. This period of time is preferably known as the vehicle battery timeout. When the vehicle battery timeout expires, ECM 12 preferably turns OFF and will not turn ON until the alternator is operating. Preferably, AFES 10 will only turn ON when an alternator is detected as the power source. If the vehicle's battery is disconnected when the alternator turns OFF, backup battery module 20 preferably keeps ECM 12 operating for a period of time known as the backup battery timeout. Alternator detection is preferably disabled to turn ECM 12 on with a bench-top DC power supply or battery. This function is preferably used during development and testing where an alternator is not available as a power supply. ECM 12 is preferably configured with details of each module, including optical sensors 18, in AFES 10. The parameters preferably include: module serial number, module type, module zone, tank and shot (if the module is a release module 26), discharge zones (for remote discharge switch(es) 22), and pressure feedback enable (for release modules(s) 26).

Preferably, a module serial number uniquely identifies each module. ECM 12 preferably uses the serial number to setup the communication network during the SDR. Serial numbers are preferably reported in the history log to associate an event to a module. ECM 12 preferably uses module type to determine the functionality of the module. The module zone preferably locates the module in a particular zone of the AFES 10. Preferably, tank and shot parameters for release module(s) 26 are uniquely identified for each suppressor assembly 14 in a zone. The shot count preferably designates a number of shots discharged from a suppressor assembly 14. Remote discharge switch(es) 22 are preferably programmed to identify the zone(s) in which suppression agent(s) are discharged when remote discharge switch(es) 22 are activated. Preferably, release modules 26 are programmed to provide pressure feedback to monitor for low cylinder pressure as well as verify successful flow during a discharge. Release modules 26 without pressure feedback preferably are assumed to have proper pressure and, when corresponding suppressor assemblies 14 are discharged, it is assumed that suppression agent flowed successfully. Preferably, a disabled pressure feedback circuit during a discharge is reported in the history log.

While the present invention has been disclosed with reference to certain embodiments, numerous modifications, alterations, and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What is claimed is:

1. A system for suppressing fire in a plurality of vehicle compartments, the system comprising:

an electronic control module;

a first sensor configured to detect fire in a first compartment;

a second sensor configured to detect fire in a second compartment;

a first data bus operatively coupling the electronic control module with the first and second sensors in a first electrical loop completed by a first terminator module;

a first node configured to release a first fire suppressing agent in the first compartment;

a second node configured to release a second fire suppressing agent in the second compartment; and a second data bus operatively coupling the electronic control module with the first and second nodes in a second electrical loop completed by a second terminator module, the second data bus communicating with the first and second nodes independently of the first data bus communicating with the first and second sensors;

wherein polls on the first data bus from the electronic control module to the first and second sensors include smaller size messages that occur more frequently than polls on the second data bus from the electronic control module to the first and second nodes.

2. A system for suppressing fire, the system comprising:

an electronic control module;

a first data bus operatively coupling the electronic control module with at least one sensor configured to detect fire, the electronic control module and at least one sensor being coupled in a first electrical loop completed by a first terminator module; and a second data bus operatively coupling the electronic control module with at least one node configured to release a fire suppressing agent, the electronic control module and at least one node being coupled in a second electrical loop completed by a second terminator module;

wherein the electronic control module polls the at least one sensor on the first data bus at a first polling frequency and polls the at least one node on the second data bus at a second polling frequency that is slower than the first polling frequency.

3. A system for suppressing fire, the system comprising:

an electronic control module;

a first data bus operatively coupling the electronic control module with at least one sensor configured to detect fire, the at least one sensor consisting of at least one optical sensor, the electronic control module and at least one sensor being coupled in a first electrical loop completed by a first terminator module;

a second data bus operatively coupling the electronic control module with at least one node configured to release a fire suppressing agent, the electronic control module and at least one node being coupled in a second electrical loop completed by a second terminator module; and wherein the electronic control module polls the at least one optical sensor on the first data bus with first messages having a first size and polls the at least one node on the second data bus with second messages having a second size, and the second size of the second messages is greater than the first size of the first messages.

4. A system for suppressing fire, the system comprising:

an electronic control module;

a first data bus operatively coupling the electronic control module with at least one sensor configured to detect fire, the electronic control module and at least one sensor being coupled in a first electrical loop completed by a first terminator module;

a second data bus operatively coupling the electronic control module with at least one node configured to release a fire suppressing agent, the electronic control module and at least one node being coupled in a second electrical loop completed by a second terminator module;

wherein the electronic control module is configured to communicate first polling messages to the at least one sensor and to communicate second polling messages to the at least one node, and neither the first data bus nor the second data bus communicate both the first and second polling messages.

5. A system configured to suppress a fire with a suppressing agent, the system comprising:

a sensor on a first electrical loop completed by a first terminal modulator and configured to detect the fire; and a suppressor on a second electrical loop completed by a second terminal modulator, the suppressor being in communication with the sensor and configured to extinguish a simulated fire with the suppressing agent in less than 300 milliseconds after inception of the simulated fire, the simulated fire including Jet Propellant 8 fuel being preheated to approximately 180-190° Fahrenheit, pressurized to approximately 1200 pounds per square inch, introduced into an approximately 260 cubic foot compartment, ignited for approximately 250 milliseconds after being introduced into the compartment, and flowing into the compartment for approximately 1.25 seconds.

6. The system of claim 1 wherein at least one of the first sensor, the second sensor, the first node and the second node includes a processor communicating status of the device to the electronic control module in response to polling by the electronic control module.

7. The system of claim 1 wherein the electronic control module prioritizes messages received from the first and second nodes.

8. The system of claim 7 wherein the electronic control module includes a discharge manager coupled to the second data bus and configured to prioritize significance of messages sent to the first and second nodes.

9. The system of claim 2 wherein the electronic control module includes at least one cache and the electronic control module compares a poll of the at least one sensor with a preceding poll stored in the cache for the at least one sensor.

10. The system of claim 9 wherein the electronic control module analyzes the poll only if it differs from the preceding poll stored in the cache for the at least one sensor.

11. The system of claim 2 wherein first polling frequency is at least approximately 10 times faster than the second polling frequency.

12. The system of claim 3 wherein the second size is at least approximately two times larger than the first size.

13. The system of claim 3 wherein the electronic control module communicates a third message having a third size to an individual sensor along the second data bus for at least one of:

re-polling the individual sensor to obtain further information about an error returned in response to the first message; and confirming fire detection by the individual sensor;

wherein the third size is greater than the first size.

14. The system of claim 4 wherein there are more nodes than sensors.

15. The system of claim 14 wherein there are eight or fewer sensors.

16. The system of claim 5, wherein Hydrogen Fluoride developed in the compartment is less than approximately 1000 parts per million.

17. The system of claim 16, wherein Hydrogen Fluoride developed in the compartment is less than approximately 746 parts per million.

18. The system of claim 5 wherein the suppressor is configured to extinguish the fire in less than approximately 200 milliseconds after the inception of the fire.

19. The system of claim 5 wherein the suppressor is configured to disperse the suppressing agent in the compartment in a concentration not greater than a Lowest Observed Adverse Effects Level in accordance with Sections 1.4 and 1.5 of NFPA 2001.

20. The system of claim 1, wherein each of the first and second sensors detects a fire in less than 10 milliseconds and each of the first and second nodes releases fire suppressing agent in less than 100 milliseconds following inception of the fire.

* * * * *